US008297156B2

(12) United States Patent
Chiu

(10) Patent No.: US 8,297,156 B2
(45) Date of Patent: Oct. 30, 2012

(54) HAND TOOL

(76) Inventor: Hung-Yen Chiu, Taiping (TW)

( * ) Notice: Subject to any disclaimer, the term of this patent is extended or adjusted under 35 U.S.C. 154(b) by 265 days.

(21) Appl. No.: 12/784,539

(22) Filed: May 21, 2010

(65) Prior Publication Data

US 2011/0283841 A1 Nov. 24, 2011

(51) Int. Cl.
*B25B 23/16* (2006.01)
*B25G 1/04* (2006.01)

(52) U.S. Cl. ..... 81/177.8; 81/177.2; 81/73

(58) Field of Classification Search ..... 81/177.8, 81/73, 177.7, 177.2
See application file for complete search history.

(56) References Cited

U.S. PATENT DOCUMENTS 2,182,673 A * 12/1939 Magnano ..... 81/177.8
5,280,740 A * 1/1994 Ernst ..... 81/73
6,234,049 B1 * 5/2001 Ju et al. ..... 81/177.7
6,684,740 B2 * 2/2004 Lin ..... 81/177.2
7,299,718 B2 * 11/2007 Hsieh ..... 81/73

* cited by examiner

*Primary Examiner* — Hadi Shakeri
(74) *Attorney, Agent, or Firm* — Alan Kamrath; Kamrath IP Lawfirm, PA

(57) ABSTRACT

A hand tool includes a tool head and a handle connected to the tool head. The tool head is adapted to drive a fastening member. The handle includes an external tube adapted to be held by a user, and an internal rod inserted into the external tube. One end of the internal rod is connected to the tool head. The external tube can be selectively moved relative to the internal rod between a first position and a second position. While in the first position, the external tube is securely engaged with the internal rod. While in the second position, the external tube is rotatable relative to the internal rod so that the user can regulate the external tube of the handle in the first position or the second position upon demands, thereby obtaining comfortable and power-saving operation.

2 Claims, 8 Drawing Sheets

HAND TOOL

BACKGROUND OF THE INVENTION

The present invention relates to a hand tool and, more particularly, to a wrench with a handle which is capable of pivotally rotating relative to a tool head of the wrench.

Normally, a hand tool, such as a wrench, is utilized to tightly lock or release a fastening member such as a screw. A conventional hand tool includes a tool head and a handle held by a user. One end of the handle is connected to the tool head so that a torsion imposed on the handle can be transferred to the tool head. Moreover, the handle is generally rotatable relative to the tool head so that the user is allowed to change the angle of the handle that is relative to the tool head based upon the demand of operational conditions. More specifically, the handle is relative to the tool head forming 180 degrees so that the hand tool can be a straight line shape. Alternatively, the handle is relative to the tool head forming 90 degrees so that the hand tool can be an L-shape.

The handle is relative to the tool head forming different angles to favor operating. However, when the operational mode of the hand tool is that the handle is relative to the tool head forming 90 degrees, the process of the axial rotation for the handle held by the user vertically surrounding the tool head is uncomfortable due to imperfect hand and wrist positions, adversely affecting the flexibility of operating. Consequently, different hand tools are required for rotating operation at different angles.

BRIEF SUMMARY OF THE INVENTION

Therefore, it is an objective of the present invention to overcome the aforementioned shortcoming and deficiency of the prior art by providing a hand tool allowing a user to selectively regulate a handle of the hand tool so that the handle is rotatable relative to a tool head of the handle tool or is incapable of rotating relative to the tool head. Thereby, comfortable and power-saving operation can be obtained when the handle is relative to the tool head forming 90 degrees, 180 degrees, or other degrees.

To achieve the foregoing objective, the hand tool of the present invention includes a tool head and a handle connected to the tool head. The tool head is adapted to drive a fastening member. The handle includes an external tube and an internal rod. An internal wall of a tube hole of the external tube has a recessed portion. The internal rod includes first and second ends spaced in an axial direction, and a middle portion located between the first and second ends of the internal rod. The first end of the internal rod is connected to the tool head. The middle portion and the second end of the internal rod are inserted into the tube hole of the external tube so that the external tube can be selectively moved relative to the internal rod in the axial direction between a first position and a second position. The middle portion of the internal rod includes a protrusion portion. The internal rod further includes a positioning component. The positioning component is located between the second end and the protrusion portion of the internal rod in the axial direction. When the external tube is in the first position, the recessed portion of the external tube is engaged with the protrusion portion of the internal rod, and the positioning component abuts against the internal wall of the tube hole of the external tube so that the external tube is firmly engaged with the internal rod. When the external tube is in the second position, the recessed portion of the external tube is separated from the protrusion portion of the internal rod so that the external tube can be rotated relative to the internal rod.

In the most preferred form, the tool head of the hand tool is provided with a driving member for driving the fastening member, and one end of the tool head is pivotally connected to the first end of the internal rod of the handle. The internal rod includes a containing chamber, and the positioning component is a steel ball and contained in the containing chamber. A spring is installed inside the containing chamber to bias the ball so that a portion of the ball protrudes out of an external surface of the internal rod.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
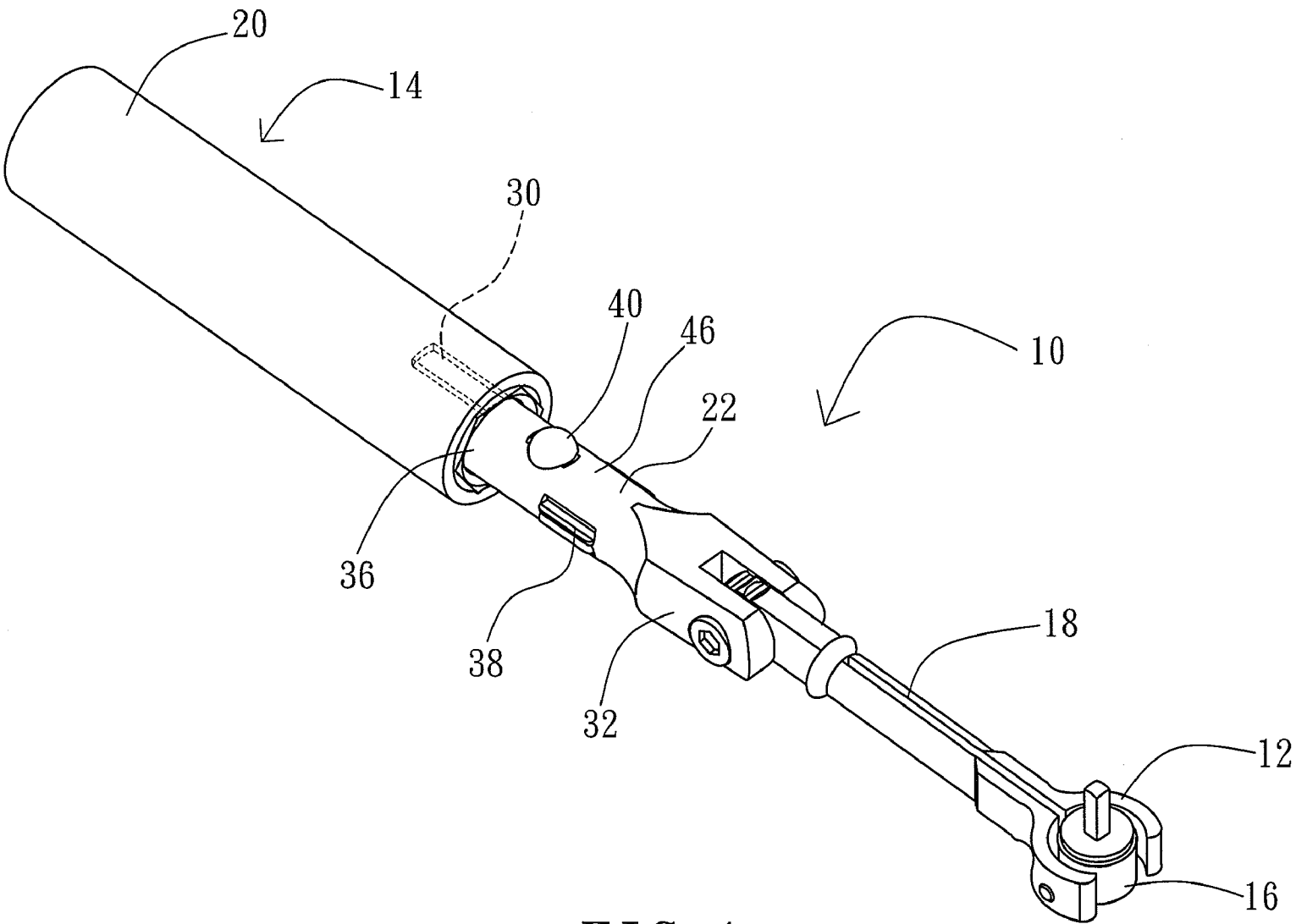
FIG. 1 is a three-dimensional diagram of a hand tool according to a first embodiment of the present invention.
Figure 2:
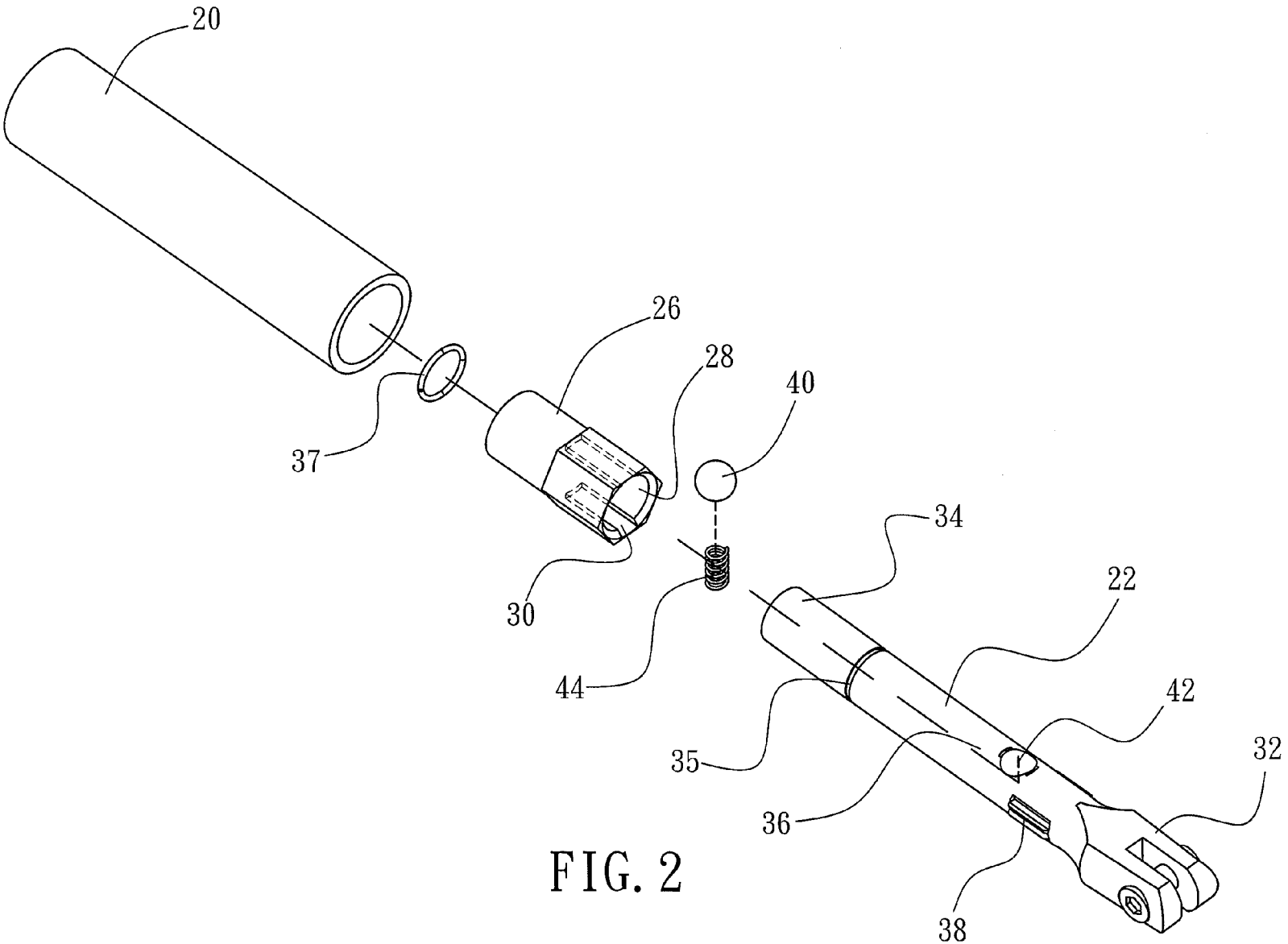
FIG. 2 is an exploded, perspective view of a handle of the hand tool according to FIG. 1.

With reference to FIG. 1 to FIG. 6, a hand tool 10 of the present invention includes a tool head 12 and a handle 14. In the embodiment, the hand tool 10 is a ratchet wrench. The tool head 12 is provided with a driving member 16 capable of unidirectional-rotating to connect a sleeve, thereby driving a fastening member such as a screw. A connection section 18 is extended from one end of the tool head 12.

The handle 14 includes an external tube 20 adapted to be held by a user and an internal rod 22. The external tube 20 includes an inside having a tube hole 24 with circular cross sections. In the embodiment, the tube hole 24 is defined by an inner hole of a hexagonal sleeve 26 combined inside the external tube 20. The tube hole 24 includes an internal wall 28. The internal wall 28 has two recessed portions 30, which correspond to each other, disposed to a peripheral direction of the tube hole 24 and extending in an axial direction of the external tube 20.

The internal rod 22 includes first and second ends 32 and 34 spaced in the axial direction and a middle portion 36 located between the first end 32 and the second end 34. The second end 34 and the middle portion 36 of the internal rod 22 are movably inserted into the tube hole 24 of the external tube 20 in the axial direction. The second end 34 of the internal rod 22 has an annular groove 35. A snap ring 37 is disposed inside the annular groove 35. The snap ring 37 is mounted in the external tube 20 and at a rear of the sleeve 26 to prevent the internal rod 22 from being separated from the external tube 20 (referring to FIG. 4). The first end 32 of the internal rod 22 is exposed to the external tube 20 and pivotally connected to the connection section 18 of the tool head 12 so that the tool head 12 can be pivoted relative to the internal rod 22 to change the angle for the handle 14 that is relative to the tool head 12. The middle portion 36 of the internal rod 22 includes two protrusion portions 38, which correspond to each other, disposed on a periphery of the internal rod 22 and extending in the axial direction. The internal rod 22 further includes a positioning component 40. In the embodiment, the positioning component 40 is a steel ball and contained in a containing chamber 42. The containing chamber 42 is disposed on the internal rod 22 and between the second end 34 and the protrusion portions 38 of the internal rod 22 in the axial direction. A spring 44 is installed inside the containing chamber 42 to bias the ball so that an outermost portion of the ball protrudes out of an external surface 46 of the internal rod 22.

Figure 3:
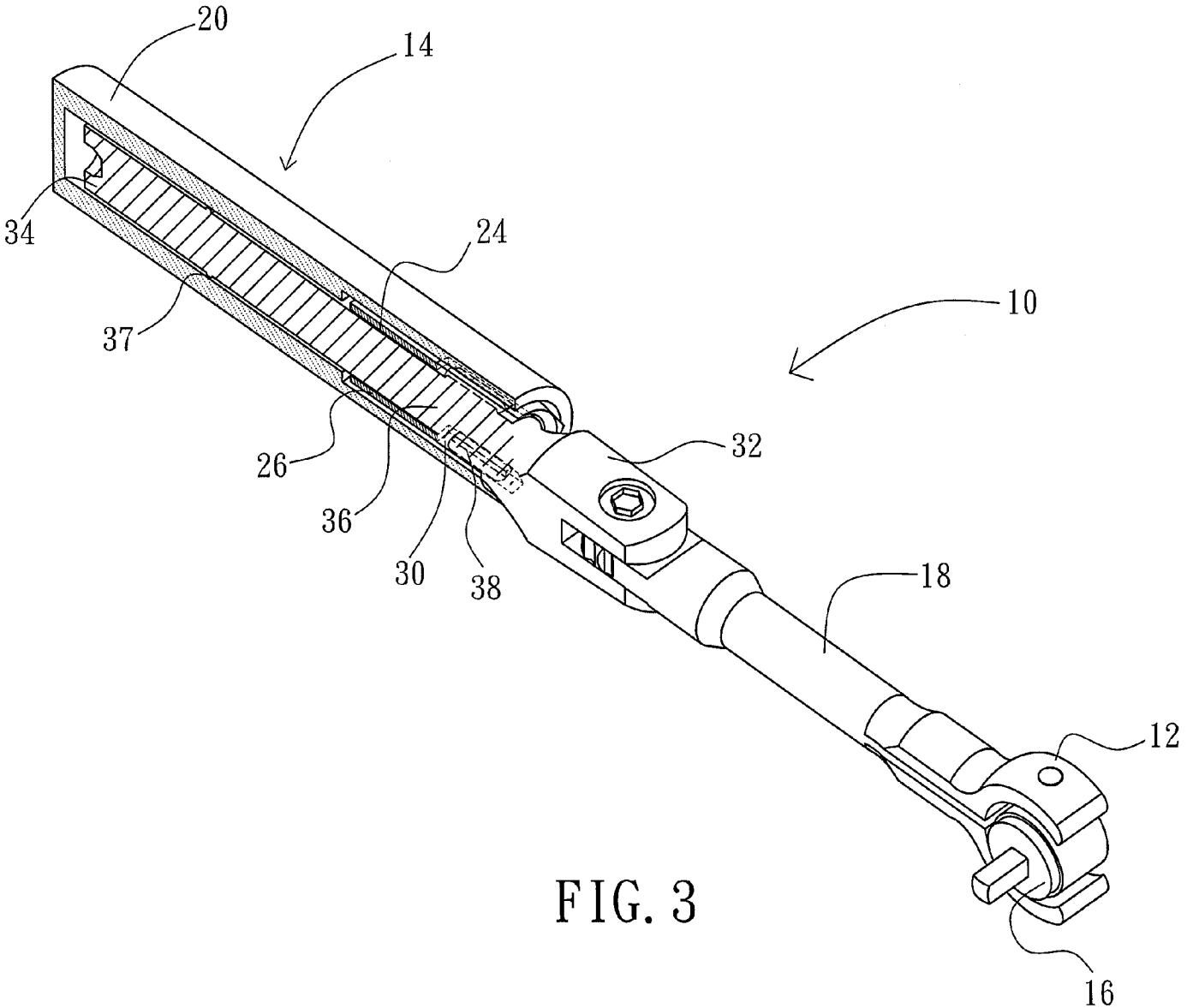
FIG. 3 is a partial cross sectional view of the hand tool according to FIG. 1, showing the position movement of an external tube of the handle.
Figure 4:
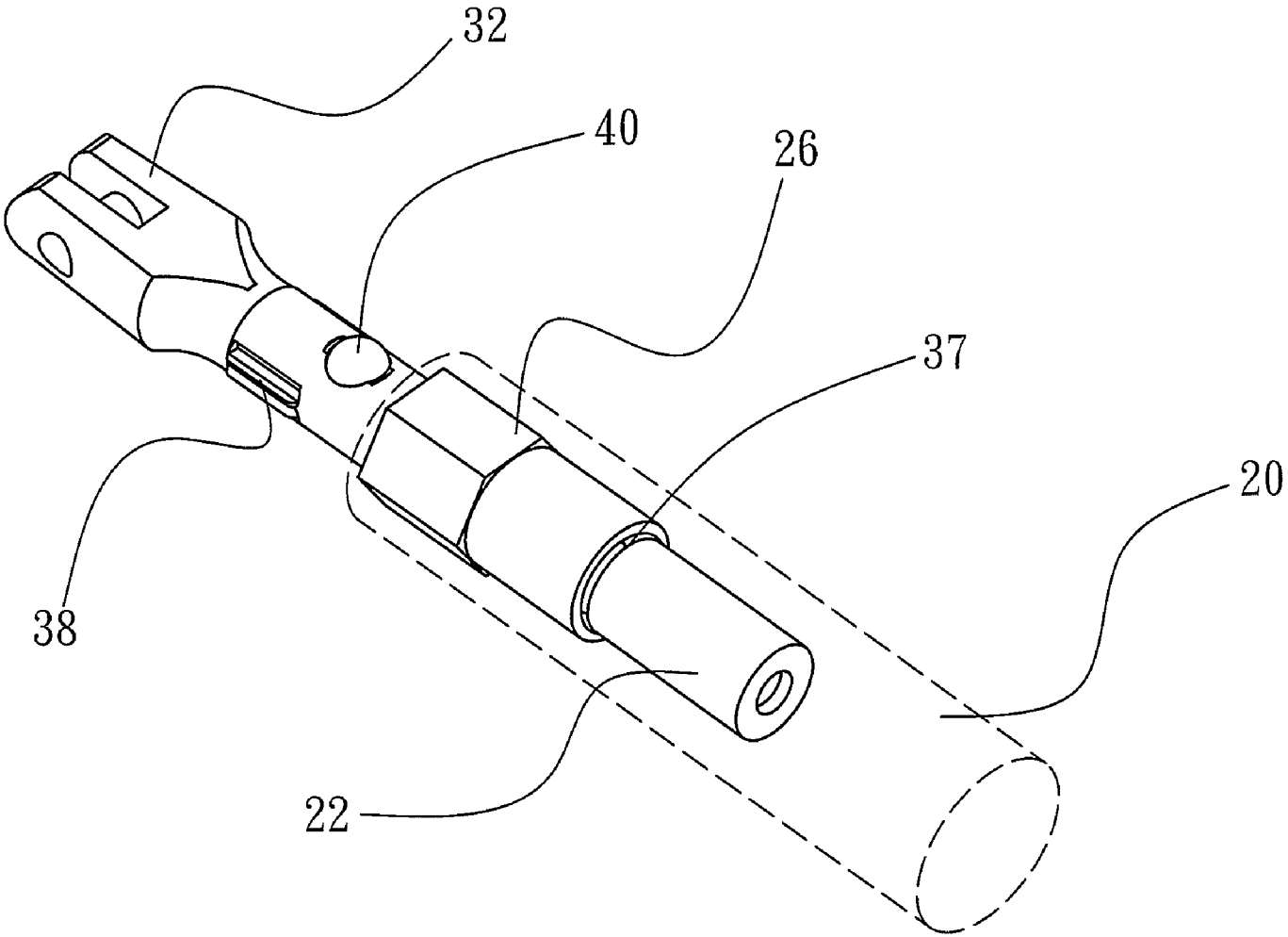
FIG. 4 is a schematic diagram of an internal structure of the external tube of the handle of the hand tool according to FIG. 1.
Figure 5:
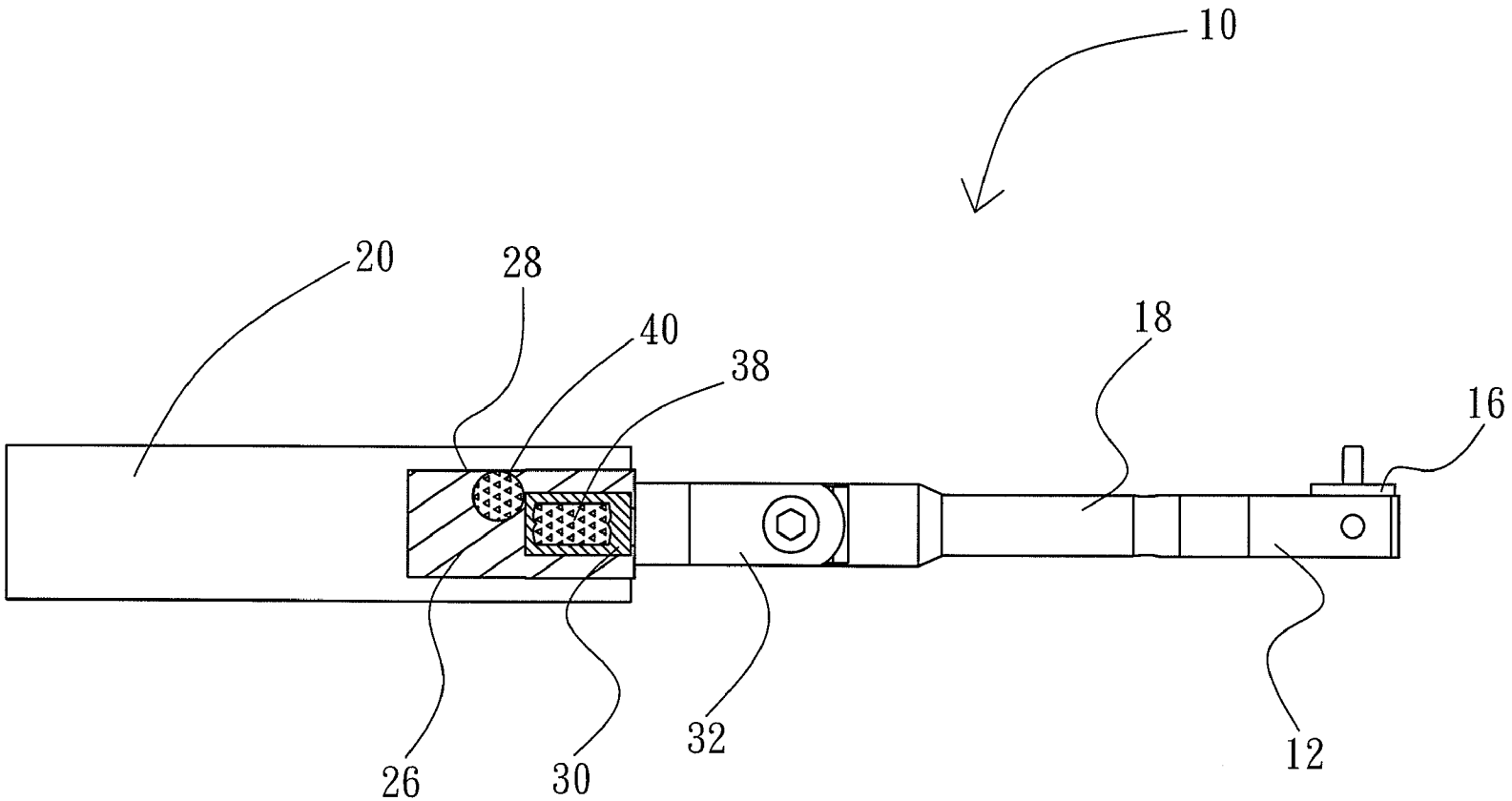
FIG. 5 is a schematic diagram of an operational state of the hand tool according to FIG. 1.
Figure 6:
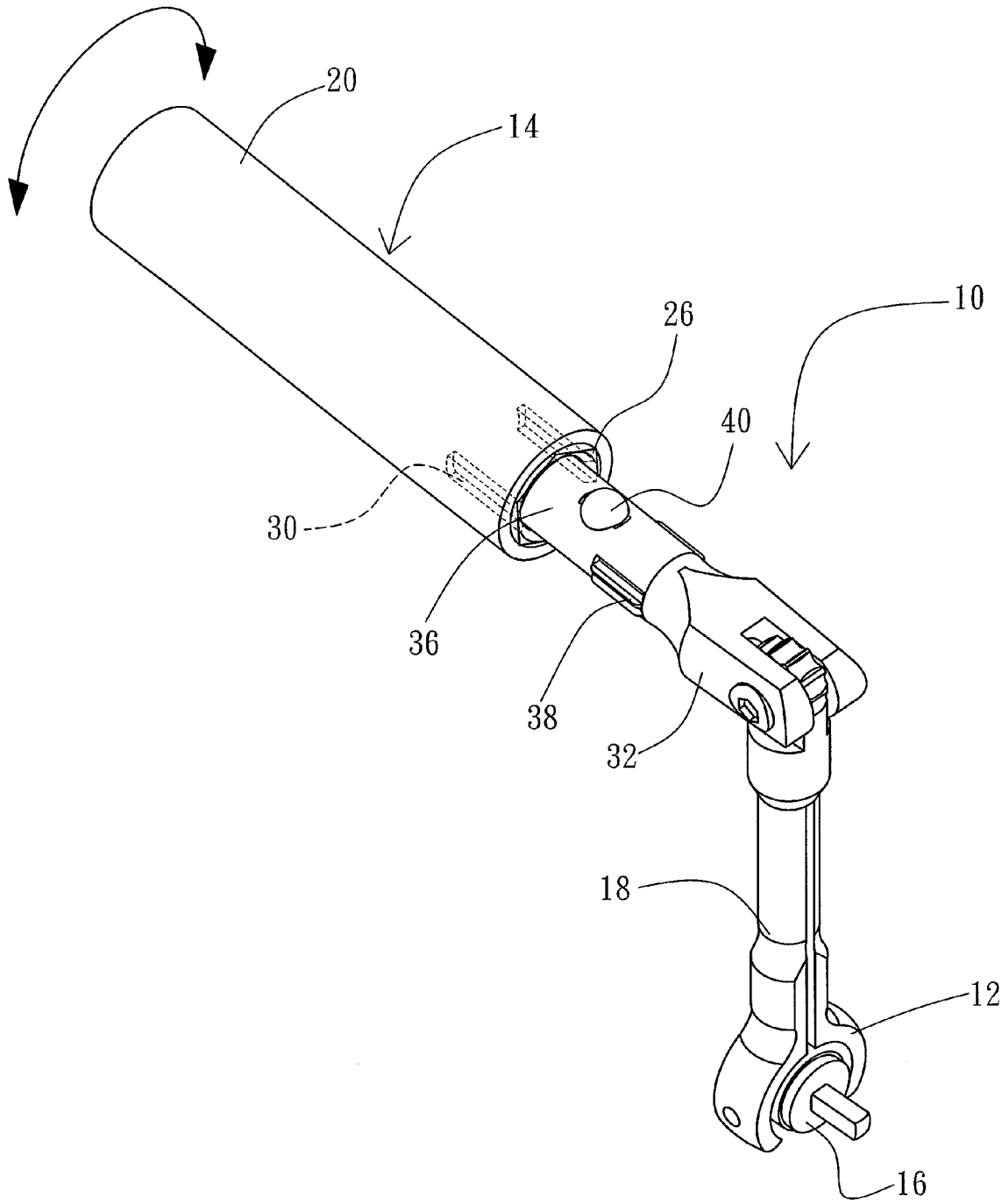
FIG. 6 is a schematic diagram of another operational state of the hand tool according to FIG. 1.

The external tube 20 of the handle 14 is moveable relative to the internal rod 22 in the axial direction between a first position and a second position. As shown in FIG. 3 and FIG. 5, when the external tube 20 is in the first position, the recessed portions 30 of the external tube 20 are engaged with the protrusion portions 38 of the internal rod 22 to prevent the external tube 20 from rotating relative to the internal rod 22. The positioning component 40 simultaneously abuts against the internal wall 28 of the external tube 20 to form a resistance to an axial movement of the external tube 20 relative to the internal rod 22. The resistance magnitude allows the external tube 20 to be forcibly moved by the user from the first position to the second position. With reference to FIG. 1 and FIG. 6, when the external tube 20 is in the second position, the recessed portions 30 of the external tube 20 are separated from the protrusion portions 38 of the internal rod 22 so that the external tube 20 is rotatable relative to the internal rod 22 by surrounding the axial direction.

With reference to FIG. 5, when an operational mode of the hand tool 10 is that the handle 14 is relative to the tool head 12 to form a straight line shape of 180 degrees, the user can move the external tube 20 to the first position so that the external tube 20 is firmly engaged with the internal rod 22. The user then operates the handle 14 with comfort and power-saving. With reference to FIG. 6, when the operational mode of the hand tool 10 is that the handle 14 is relative to the tool head 12 to form an L-shape of 90 degrees, the user can move the external tube 20 to the second position so that the external tube 20 can be rotated relative to the internal rod 22. Under this condition, the hand and the wrist of the user can obtain optimum and accurate force-imposing position to enhance the operational flexibility, and the user is also allowed to operate the handle 14 with comfort and power-saving.

The feature of the invention is that the user is allowed to utilize the same hand tool 10 to perform the operational modes in which the handle 14 is relative to the tool head 12 forming 90 degrees, 180 degrees, or other degrees. Simultaneously, the user is allowed to selectively move the external tube 20 to the first position or the second position to operate the handle 14 with comfort and power-saving.

Figure 7:
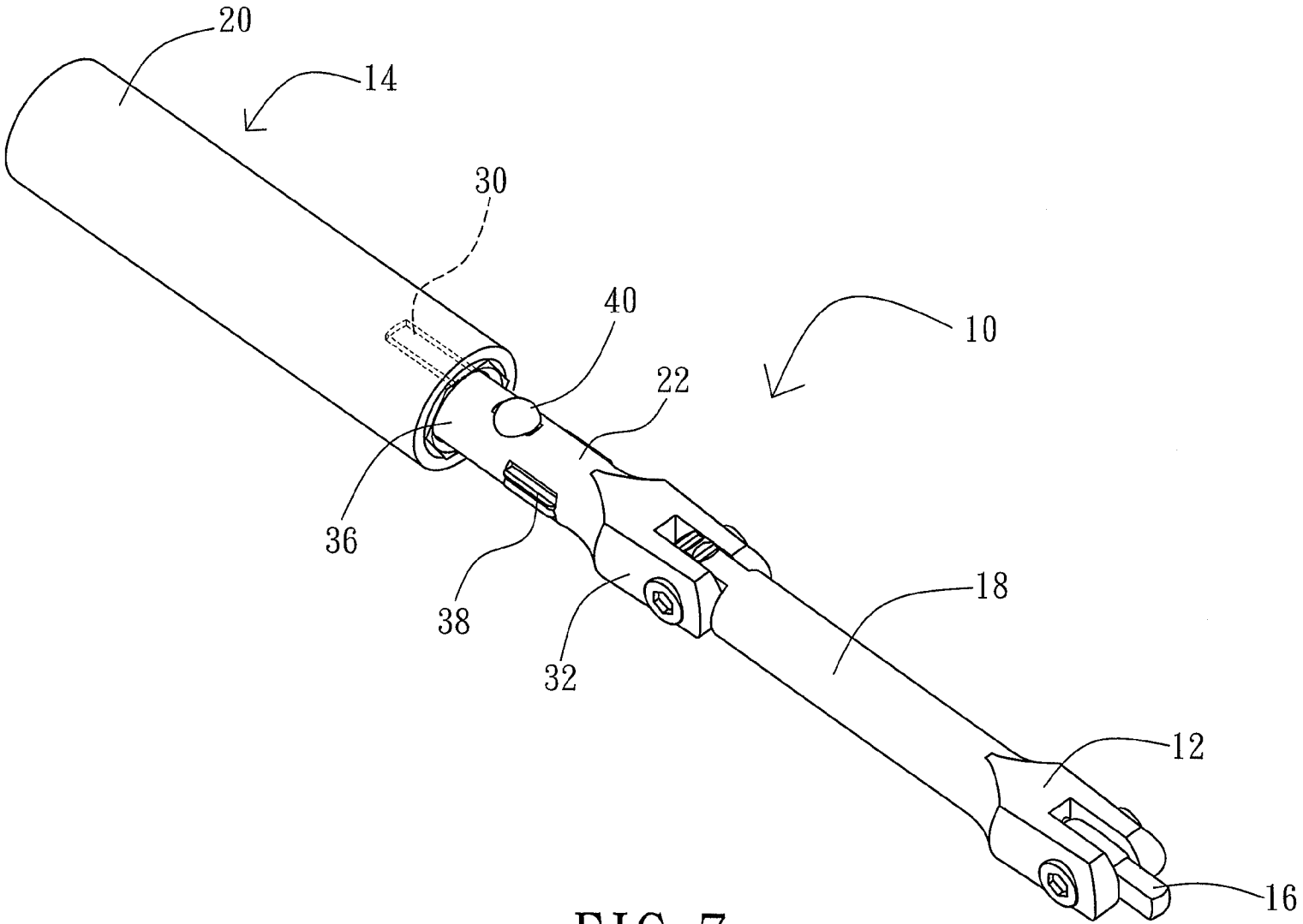
FIG. 7 is a three-dimensional diagram of a hand tool according to a second embodiment of the present invention.
Figure 8:
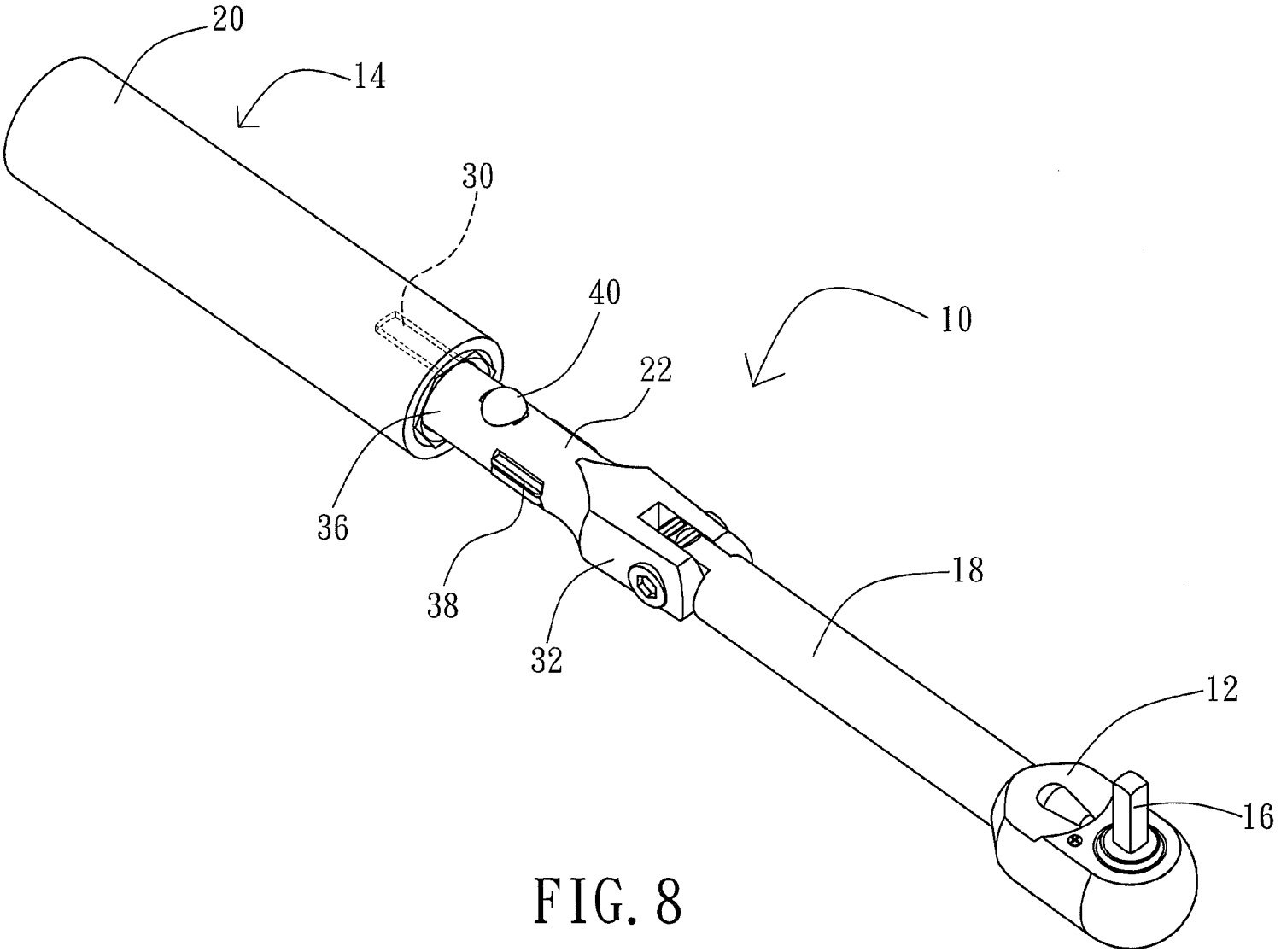
FIG. 8 is a three-dimensional diagram of a hand tool according to a third embodiment of the present invention.

It should be noted that the hand tool 10 is not limited to the ratchet wrench of FIG. 1 to FIG. 6. With reference to FIG. 7 and FIG. 8, the tool head 12 of the hand tool 10 can be provided with another type of driving members 16. Moreover, the number of the recessed portion 30 and the protrusion portion 38 can be one or more than two.

The present invention improves over the prior art. While the invention has been described by device of specific embodiments, numerous modifications and variations could be made thereto by those generally skilled in the art without departing from the scope and spirit of the invention set forth in the claims.

The invention claimed is:

1. A hand tool comprising a tool head and a handle connected to the tool head, with the tool head adapted to drive a fastening member, with the handle comprising:

an external tube adapted to be held by a user, with the external tube including an inside of an axial length from an open end;

a sleeve located within the inside of the external tube, with the sleeve having an axial length from a front to a rear less than the axial length of the external tube, with the sleeve non-movably combined in the inside of the external tube with the front being generally coextensive with the open end, wherein a tube hole within the inside of the external tube is defined by an inner hole of the sleeve combined inside the external tube, with the sleeve including an internal wall having a recessed portion extending axially outward of the internal wall and axially from the front; and an internal rod including first and second ends spaced in an axial direction and a middle portion located between the first and second ends of the internal rod, with the first end of the internal rod connected to the tool head, with the second end and the middle portion of the internal rod inserted into the tube hole, with the external tube and the sleeve simultaneously moveable relative to the internal rod in the axial direction between a first position and a second position, with the middle portion of the internal rod having a protrusion portion integrally extending axially from the internal rod, with the internal rod further including a positioning component located between the second end and the protrusion portion of the internal rod in the axial direction, with a portion of the positioning component protruding out of an external surface of the internal rod, wherein the second end of the internal rod is provided with an annular groove; and a snap ring installed in the annular groove, and wherein the snap ring is mounted in the inside of the external tube and abutting the rear of the sleeve to prevent the internal rod from being separated from the external tube and the sleeve combined inside the external tube;

wherein with the external tube and the sleeve in the first position, the recessed portion of the external tube is engaged with the protrusion portion of the internal rod and the positioning component abuts against the internal wall of the tube hole of the sleeve; wherein with the external tube and the sleeve in the second position, the recessed portion is separated from the protrusion portion of the internal rod and the external tube and the sleeve are rotatable relative to the internal rod.

2. The hand tool as claimed in claim 1, wherein the tool head is provided with a driving member for driving the fastening member, wherein one end of the tool head is pivotally connected to the first end of the internal rod, wherein the internal rod includes a containing chamber, wherein the positioning component is a ball contained in the containing chamber and a spring installed inside the containing chamber to bias the ball so that the portion of the ball protrudes out of the external surface of the internal rod, and with the external tube and the sleeve in the first position, the ball abuts against the internal wall to form a resistance to an axial movement of the external tube and the sleeve relative to the internal rod.

* * * * *